United States Patent [19]

Bridges

[11] Patent Number: 4,750,616

[45] Date of Patent: Jun. 14, 1988

[54] PACKAGING CONTAINER FOR FEMALE UNDERGARMENTS

[76] Inventor: Paul Bridges, 2222 Richland Dr., Louisville, Ky. 40218

[21] Appl. No.: 58,789

[22] Filed: Jun. 5, 1987

[51] Int. Cl.[4] ..... B65D 85/18

[52] U.S. Cl. ..... 206/284

[58] Field of Search ..... 206/284, 278, 287, 287.1

[56] References Cited

U.S. PATENT DOCUMENTS

| | | | |
|---|---|---|---|
| 2,383,389 | 8/1945 | Illion | 206/278 |
| 3,929,224 | 12/1975 | Smith, Jr. | 206/287 |
| 3,999,656 | 12/1976 | Hydorn | 206/287 |

FOREIGN PATENT DOCUMENTS

| | | | |
|---|---|---|---|
| 508262 | 6/1939 | United Kingdom | 206/284 |
| 763681 | 12/1956 | United Kingdom | 206/278 |
| 1132861 | 11/1968 | United Kingdom | 206/278 |
| 1411390 | 10/1975 | United Kingdom | 206/278 |

*Primary Examiner*—William Price
*Attorney, Agent, or Firm*—Scott R. Cox

[57] ABSTRACT

A packaging container for female undergarments is disclosed consisting of a clear, plastic packaging container sealed at one end, a second end closed by a hooked pull-top, a holding bag, said holding bag fitting within the plastic packaging container and containing a loop for attachment to the hook of the hooked pull-top and a female undergarment folded in such a manner as to fit within the holding bag as it is placed within the packaging container.

9 Claims, 2 Drawing Sheets

PACKAGING CONTAINER FOR FEMALE UNDERGARMENTS

CROSS REFERENCE TO RELATED APPLICATIONS

NONE.

STATEMENT AS TO RIGHTS TO INVENTIONS MADE UNDER FEDERALLY SPONSORED RESEARCH AND DEVELOPMENT

NONE.

BACKGROUND OF INVENTION

1. Field of Invention

This invention relates to a packaging container for clothing. In particular, this invention discloses a disposable packaging container for female undergarments.

2. Prior Art

In certain situations, especially during their menstrual cycle, females desire to carry an extra set of undergarments. In the past, this problem has only been solvable by the female carry an extra undergarment with her in her purse or other container.

One possible solution for this problem is a disposable undergarment secured to a cardboard-like support card which can be carried by the female. See U.S. Pat. No. 3,616,975. However, these support cards are bulky, do not hold the undergarments securely and are not easy to carry.

Therefore, an object of this invention is to provide a convenient packaging container for female undergarments which can be easily carried.

It is a further object of this invention to provide a disposable packaging container which is tubular in shape which will hold female undergarments.

It is an additional object of this invention to provide a disposable packaging container for female undergarments which may be placed on a display rack for display purposes.

These and other objects as well as the scope, nature and utilization of the invention will be apparent to those skilled in the art from the drawings, detailed description and appended claims.

SUMMARY OF THE INVENTION

The present invention comprises a disposable packaging container for female undergarments comprising:

a. a plastic packaging container with one end sealed;

b. a second end of the plastic packaging container, sealed by a hooked pull-top, wherein the hooked pull-top is removable from the container and includes a hook directed to the inside of the container;

c. a holding bag with a loop, said holding bag fitting within the plastic packaging container, wherein the loop attaches over the hook of the hooked pull-top when the holding bag is within the plastic packaging container; and d. a female undergarment folded in such a manner as to fit within the holding bag when it is placed inside of the packaging container.

This plastic packaging container for female undergarments can be quite useful for a female to carry an extra undergarment in a convenient, easy-access container for use as needed. Further, by adding a second hooked end on the outside of the second end of the container, the container can be displayed for sale purposes.

BRIEF DESCRIPTIONS OF THE DRAWINGS

The invention will now be described with reference to the accompanying drawings in which.

DETAILED DESCRIPTION OF THE PREFERRED EMBODIMENT

Figure 1:
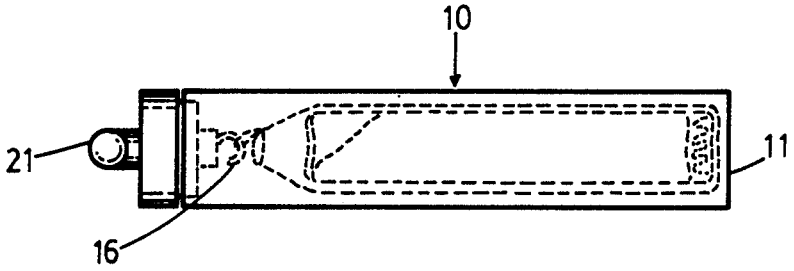
FIG. 1 is a side view of the packaging container with the holding bag containing the female undergarment within the packaging container with the hook pull-top secured.
Figure 2:
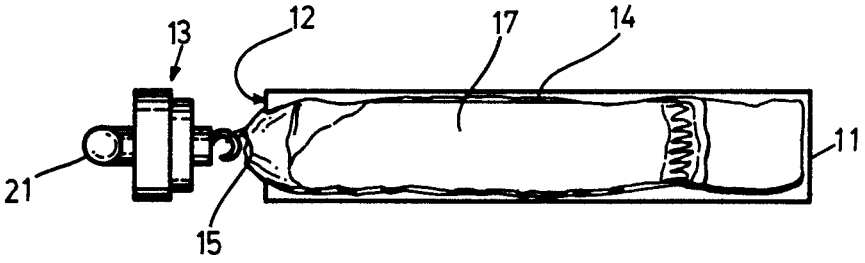
FIG. 2 is a side view of the container of FIG. 1 showing the hook pull-top removing the holding bag from the container.
Figures 3, 4:
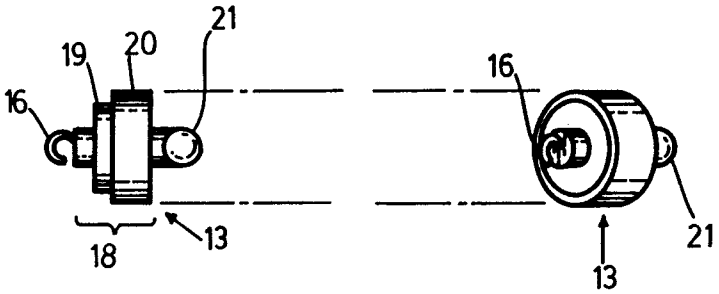
FIG. 3 is a side view of the hook pull-top.

Although the invention is applicable to a wide variety of applications, it is shown in the drawings for the purpose of illustration as embodied in a packaging container for female undergarments consisting of a packaging container (10) with a first sealed end, (11) a second end (12) sealed by a hooked pull-top, (13) which projects to the inside of the packaging container, a holding bag (14) with a loop attachment (15) which will fit over an inside hook (16) of the hooked pull-top, wherein the holding bag will fit inside of the packaging container, and a female undergarment (17) folded in such a manner as to fit within the holding bag (14) when it is inside of the packaging container (10).

The packaging container (10) can be of any shape or size manufactured in the industry, preferably in a tubular shape with cross section from about ¼ of an inch to about 2 inches and length from about 3 to about 10 inches. In an alternate embodiment, the tubing can be rectangular in cross section with length and width approximately the same.

The packaging container can be made of any clear plastic type material which is easy and inexpensive to manufacture. The first end (11) of the packaging container should be sealed while the second end (12) is closed by a use of a hooked pull-top (13). The hooked pull-top (13) consists of a means for securely closing the packaging container (18) and a hook (16) directed to the inside of the container. The means for closing the packaging container consists of a removable end (19) for the container which fits securely within the second opening of the packaging container and an outside section (20). In a preferred embodiment, the pull-top is secured to the packaging container by same type of weaken wall to allow the top to be easily removed from the packaging container. The outside section (20) of the hooked pull-top can be of any conventional size or shape. In a preferred embodiment, a second hook (21) is secured to the outside end (20) of the hooked pull-top (13) to allow the packaging container to be hung on a display stand for viewing.

The holding bag for holding the female undergarment is placed within the packaging container. The holding bag is manufactured of any clear, inexpensive, plastic-type material. One end of the holding bag should have a loop attachment (15) which will loop over the inside hook of the hooked pull-top. Any type of readily foldable female undergarment may be stored inside the holding bag.

This arrangement of hooked pull-top, (13) loop attachment (15) on the holding bag (14) and folded female undergarment within the holding bag will allow the female undergarment to be easily removed from the packaging container. The holding bag (14) may also have a weaken section to allow the holding bag to be torn opened easily for ready access to the female undergarment. In addition, the holding bag can also be used to carry home the used female undergarment.

In practice, a folded female undergarment (17) is placed within a clear plastic holding bag, (14) which bag contains a loop attachment (15). The holding bag (14) is placed within a plastic packaging container, (10) one end (11) of which has been sealed. The other end (12) is closed by a hooked pull-top, (13) the inside hook (16) of which is directed to the inside of the container and onto which is attached the attachment loop (15) of the holding bag (14). The hooked pull-top (13) securely closes the second opening of the plastic packaging container. By removing the hooked pull-top from the container, the holding bag (14) containing the female undergarment, (17) is removed from the packaging container (10). By tearing open the holding bag, (14) the female undergarment (17) is accessible.

I claim:

1. A disposable packaging container for female undergarments comprising:

a. a plastic packaging container with one end sealed;

b. a second end of the plastic packaging container, sealed by a hooked pull-top, wherein the hooked pull-top is removable from the container and includes a hook directed to the inside of the container;

c. a holding bag with a loop, said holding bag fitting within the plastic packaging container, wherein the loop attaches over the hook of the hooked pull-top, when the holding bag is within the plastic packaging container; and d. a female undergarment folded in such a manner as to fit within the holding bag, when it is placed inside of the packaging container.

2. The disposable packaging container for female undergarments of claim 1 wherein the plastic packaging container is in the shape of a tube.

3. The disposable packaging container for female undergarents of claim 1 wherein the cross section of the plastic packaging container is rectangular in shape.

4. The disposable packaging container for female undergarments of claim 1 wherein the length of the plastic packaging container is from about 3 to about 10 inches and to the cross section of the plastic packaging container is from about ¼ inch to about 2 inches.

5. The disposable packaging container for female undergarments of claim 1 wherein the plastic packaging container and the holding bag are comprised of a clear, moldable plastic-like material.

6. The disposable packaging container for female undergarments of claim 1 wherein the hooked pull-top consists of:

a. a first hooked end;

b. a closing means attached to the first hooked end for closing the second opening of the plastic packaging container; and c. a means for supporting the plastic packaging container for display attached to the closing means.

7. The disposable packaging container for female garments of claim 6 wherein the means for supporting the plastic packaging container consists of a second hook attached to the closing means for displaying the plastic packaging container.

8. The disposable packaging container for female undergarments of claim 6 wherein the closing means is a removable end for the packaging container which fits securely within the second opening of the packaging container.

9. A disposable packaging container for female undergarments comprising:

a. a clear plastic tubular packaging container with one end sealed;

b. a second end of the plastic packaging container sealed by a hooked pull-top, consisting of a first hook directing to the inside of the tubular plastic packaging container, a closing means for closing the plastic packaging container and a second hook attached to the closing means for displaying the plastic packaging container;

c. a holding bag which fits within the plastic packaging container and containing a loop which attaches to the first hook of the hooked pull-top; and d. a folded female undergarment which fits within the holding bag inside of the plastic packaging container.

* * * * *